United States Patent [19]

Lerch et al.

[11] 4,374,575

[45] Feb. 22, 1983

[54] WINDING MACHINE FOR CONTINUOUSLY WINDING STRIPS OF WEB MATERIAL INTO ROLLS

[75] Inventors: Rolf Lerch, Darmstadt-Eberstadt; Franz Held, Gross-Zimmern, both of Fed. Rep. of Germany

[73] Assignee: Maschinenfabrik Goebel GmbH, Darmstadt, Fed. Rep. of Germany

[21] Appl. No.: 213,485

[22] Filed: Dec. 5, 1980

[30] Foreign Application Priority Data

Dec. 5, 1979 [DE] Fed. Rep. of Germany ..... 2948881

[51] Int. Cl.[3] ..... B65H 75/02

[52] U.S. Cl. ..... 242/56.5; 242/65

[58] Field of Search ..... 242/65, 56.2, 56.4, 242/56.5, 56.9, 67.1 R, 68.4, 58.6

[56] References Cited

U.S. PATENT DOCUMENTS

| | | | |
|---|---|---|---|
| 2,843,915 | 7/1958 | Drake | 242/65 X |
| 3,086,726 | 4/1963 | Aaron | 242/65 |
| 3,291,412 | 12/1966 | Rockstrom et al. | 242/65 |
| 3,591,101 | 7/1971 | Gallet et al. | 242/65 X |
| 3,695,542 | 10/1972 | Briggs | 242/68.4 X |
| 3,844,502 | 10/1974 | Toy | 242/68.4 X |
| 3,998,399 | 12/1976 | Held et al. | 242/65 |

*Primary Examiner*—John M. Jillions

*Attorney, Agent, or Firm*—Watson, Cole, Grindle & Watson

[57] ABSTRACT

A winding machine for winding up into rewind rolls a plurality of strips cut from an elongated web includes contact drums respectively bearing against the rewind rolls, the contact drums being independently arranged for independently exerting pressure against their rewind rolls for independently maintaining the necessary gap values between them and the periphery of the main drum about which the strips are partially looped upon entering the machine. Detecting devices associated with pairs of support arms provided for the contact drum operate a motor associated with each of the support arm pairs for each rewind roll for simultaneously rotating a pair of spindles on the support arms so as to pivot them away from the centerline of the machine when the extent of the aforementioned gap at each contact drum is reduced below a desired minimum.

4 Claims, 5 Drawing Figures

WINDING MACHINE FOR CONTINUOUSLY WINDING STRIPS OF WEB MATERIAL INTO ROLLS

BACKGROUND OF THE INVENTION

This invention relates generally to improvements in a winding machine which continuously winds into rolls a plurality of strips cut from an elongated web, such as paper, fabric, foil, metal, plastic, etc. More particularly, the invention relates to such improvement whereby drums contacting the rolls are maintained out of contact with a main drum with which the web makes initial contact upon entering the machine.

A winding machine of the general type herein described is disclosed in U.S. Pat. No. 3,086,726 as having riding drums associated with the rewind rolls being maintained out of contact with the main drum. However, the rewind rolls are difficult to remove from their rewind shafts because of the particular arrangement involved, and rewind shafts which each support several rolls are easily bent so as to cause roll distortions during the process of rewinding. Moreover, the scanning device, which senses any changes in the gap size between the main drum and the riding drums, is not suitable for carrying out this operation with the required precision whenever various strips of variable or changeable thickness are to be wound into rolls.

SUMMARY OF THE INVENTION

It is therefore an object of the present invention to improve upon this known winding machine in such a manner as to permit the rewinding of large, heavy rolls of variable widths and made from diverse materials such as paper, foil, fabric, plastic, metals, etc.

The winding machine according to the invention is one which is capable of winding up a plurality of strips cut from an elongated web, the strips being looped partially around a main drum and being wound into a plurality of rewind rolls. Contact drums respectively bear against the rewind rolls, and means are provided for maintaining the contact drums out of contact with the main drum during build-up of the rewind rolls so as to define predetermined gaps with the main drum. And, detecting means are provided for independently and for more precisely sensing changes in the sizes of these gaps.

The rewind rolls are supported by pairs of first support arms pivotally mounted on holders for movement about axes parallel to the central axis of the main drum. The holders are mounted for movement along rails likewise lying parallel to the main drum axis. Threaded elongated spindles are engaged by sleeves pivotally mounted on the support arms, the spindles being seated on the holders. Means are provided for simultaneously rotating the spindles so as to effect pivotal movement of the support arms about their pivotal axes so as to maintain the necessary gap sizes between the contact drums and the main drum as detected by detecting means. Second support arms are mounted on the machine for pivotal movement about axes disposed at a side of the main drum opposite the side at which initial contact is made by the web upon entering the machine.

Another object of this invention is to provide such a machine wherein the spacing between the first support arms in each pair is adjustable for accommodating rewind rolls of different lengths.

A further object of the present invention is to provide such a machine wherein the means which rotate the spindles include bevel gears at the ends of the spindles, and intermeshing bevel gears at opposite ends of a detachable rod extending between the brackets. The rod may have telescoping parts to effect the change in spacing between the brackets.

A still further object of this invention is to provide such a machine wherein the holders are mounted on parallel related guide rails which are disposed at a side of the main drum opposite the side at which initial contact is made by the web.

Other objects, advantages and novel features of the invention will become more apparent from the following detailed description of the invention when taken in conjunction with the accompanying drawings.

DETAILED DESCRIPTION OF THE INVENTION

Figure 1:
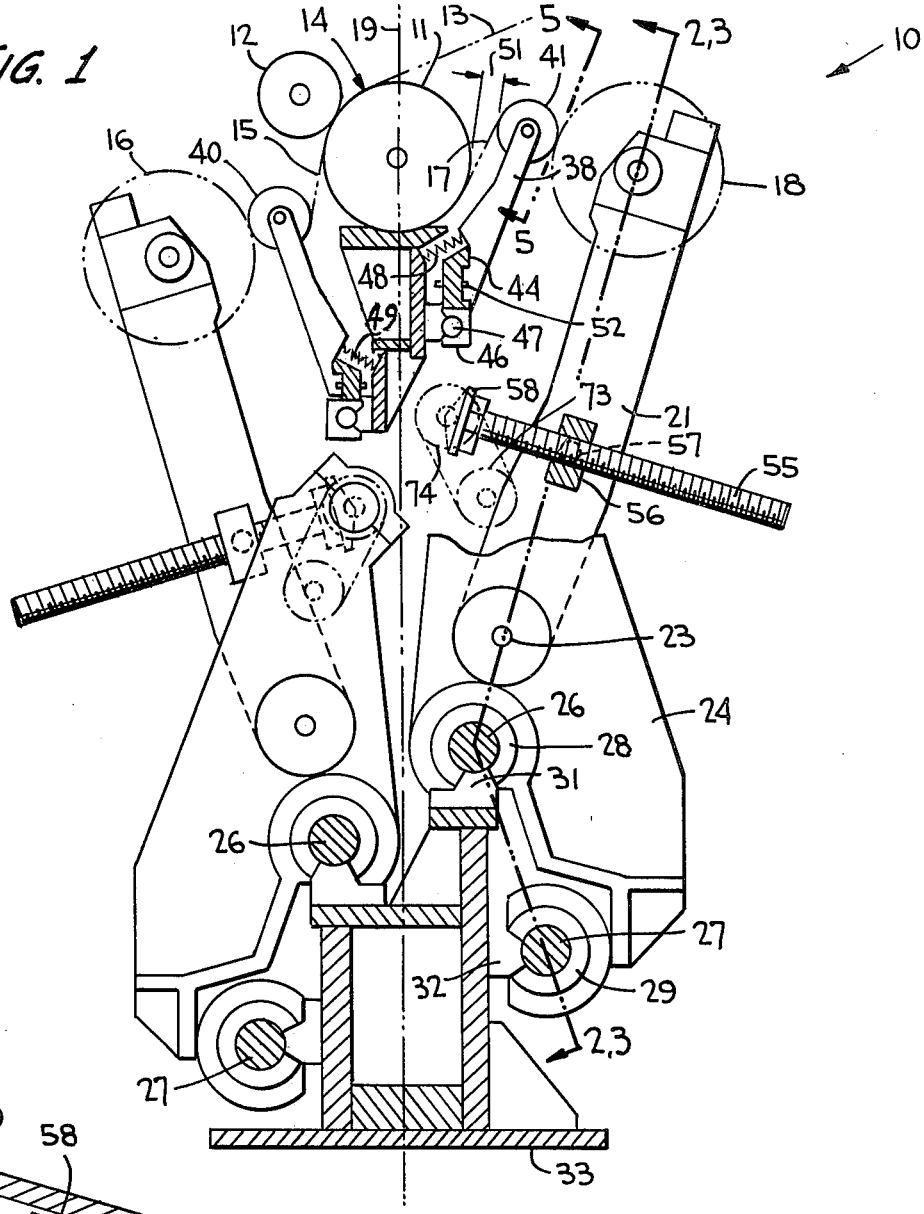
FIG. 1 is a side elevational view, partly in section, of the winding machine according to the invention.

Turning now to the drawing wherein like reference characters refer to like and corresponding parts throughout the several views, the winding machine according to the invention is generally designated 10 in FIG. 1 and includes a main drum 11 mounted in place in any normal manner for rotation about the central axis thereof, this drum having a slitting or scoring blade thereon, or being constituted as such and having a backing blade 12. Of course, several cooperating blades may be provided between 11 and 12.

An elongated web 13 of paper, foil, fabric, metal, or plastic, etc., is drawn from a supply roll (not shown) and loops partially about main drum 11 initially at a location or a line 14 of contact. The web is then slit into strips of desired widths as it passes beyond drum 11, a cut strip 15 being wound into a rewind roll 16, and a cut strip 17 being rewound into a rewind roll 18. Both rewind rolls are rotatable about their central axes, during the rewind operation, in any known manner.

A centerline 19 passing through the rotational axis of main drum 11 essentially represents a line of symmetry of the machine, so that mutually similar parts lying to the right of this line will only be described, it being understood that similar parts lying to the left of this line are of like character.

Figure 3:
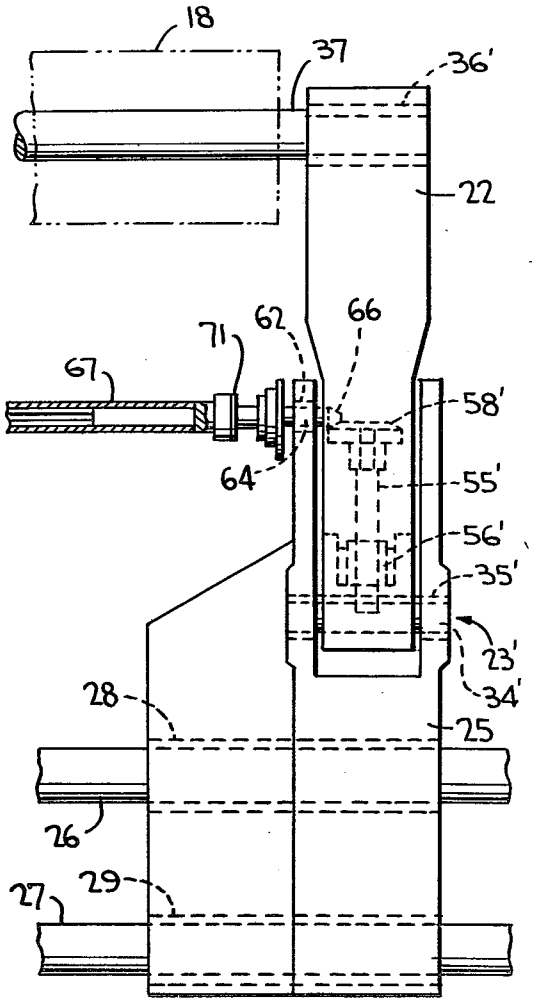
FIG. 3 is a right-hand part of a sectional view likewise taken along line 2—2 of FIG. 1.
Figure 2:
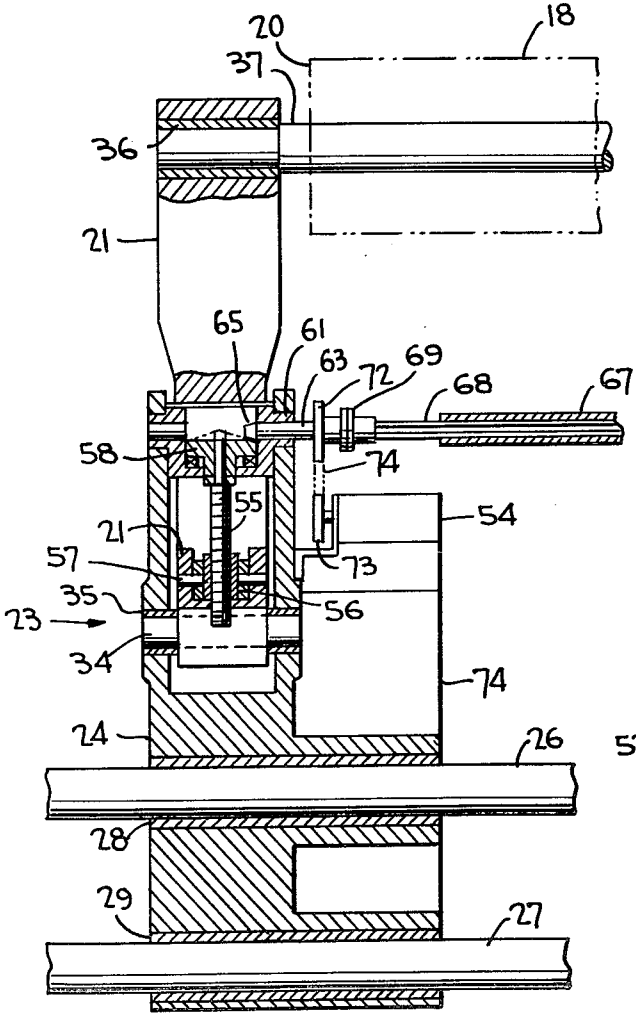
FIG. 2 is a left-hand part of a sectional view taken substantially along line 2—2 of FIG. 1.

Rewind roll 18 is supported for rotation on a shaft or a casing for rotation about its central axis between a pair of first support arms 21, 22, respectively shown in FIGS. 2 and 3 with arm 21 only being shown in FIG. 1. The arms are pivotally mounted as at 23, 23' to holders 24, 25, these pivotal axes lying parallel to the central axis of the main drum. The holders are mounted on circular guide rails 26, 27 which lie along axes likewise parallel to the central axis of the main drum. Bushings 28, 29 within the holders surround these rails and facilitate unobstructed sliding movement of the holders along the rails for purposes to be described hereinafter.

These bushings and the portions of the holders in which they are seated are C-shaped in order to avoid interference with supports 31, 32 provided for the rails. And, these circular guide rails, of which there are four in number, extend at least over the entire width of the winding machine, and may also extend beyond the operating width of the machine so that winding stations not needed for certain winding operations may be moved into inactive positions along the rails. And, holders 24 and 25 lying to the right of centerline 19 may be connected with their corresponding holders lying to the left of this centerline. Otherwise, the holders are capable of moving independently along their guide rails, as shown in FIG. 1. Supports 31, 32 have outer bearing surfaces which may be spaced apart along guide rails 26 and 27, or may be made continuous therealong. Also, supports 31, 32 each have a continuous base portion extending along the rails, and are secured to machine frame 33 as by welding or the like.

Pivot 23, at which arm 21 is connected to holder 24, is formed by a pivot pin 34 mounted on the lower end thereof for pivotal movement about its central axis within a bushing 35 mounted on holder 24. Pivot 23', as shown in FIG. 3, is similarly formed. Bushings 36, 36', provided at the upper ends of brackets 21 and 22, support the opposite ends of a shaft 37 of rewind roll 18 for relative rotation of the shaft within these bushings. Otherwise, shaft 37 may be fixed within bushings 36, 36', and cores (not shown) may be supported on chucks on which strip 17 is wound to form rewind roll 18.

Figure 5:
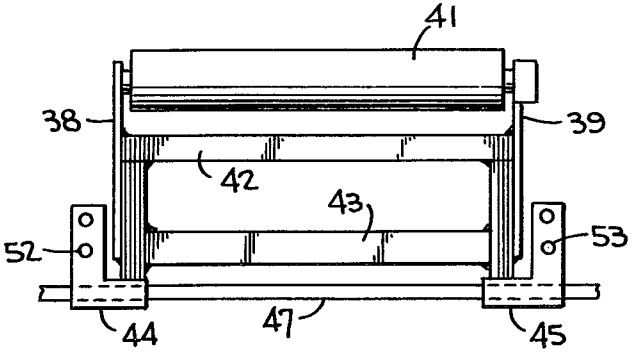
FIG. 5 is a view taken substantially along line 5—5 of FIG. 1.

A second pair of spaced support arms 38 and 39 are provided for rotatably supporting a contact drum 41 at the upper end thereof, as shown in FIG. 5. These support arms are interconnected together as at 42, 43, and are mounted on L-shaped clamp members 44, 45 provided with C-shaped bearing portions 46 (FIG. 1) at the lower ends thereof for engaging an elongated circular guide rail 47 mounted on the machine frame and extending in a direction parallel to the central axis of the main drum. Interconnected support arms 38, 39 are spring biased away from centerline 19 of the machine by means of coil springs 48, 49 for urging contact drums 40 and 41 into bearing engagement with rewind rolls 16 and 18 (see FIG. 1). The contact drum bears against its respective rewind roll as it is being wound while support arms 21 and 22 remain in a stationary position on holder 24, such as that shown in FIG. 1. As in the aforementioned prior U.S. Pat. No. 3,086,726, the contact drum must be maintained a predetermined minimum distance 51 from main drum 11 so as to define a gap which is sufficiently large to prevent peripheral contact yet sufficiently small to assure that the draw (the length of the tangent followed by strip 17 and passing from the main drum to the contact drum) is at a minimum value. The predetermined size of this gap must be maintained for each of the wind-up rolls even if the diameters thereof differ while simultaneously being wound up.

A control device, described in more detail hereinafter, is under the influence of detecting devices 52, 53 which are attached to clamps 44 and 45 of the second support arms (FIG. 5) for sensing the distance of the second support arms from an adjacent fixed portion of the machine frame so that distance can be translated into gap 51 which must be maintained. These detecting devices are suitably wired to a motor 54 (FIG. 2) of the control device for pivoting first arms 21, 22 incrementally away from centerline 19 for maintaining a predetermined gap 51 value.

Figure 4:
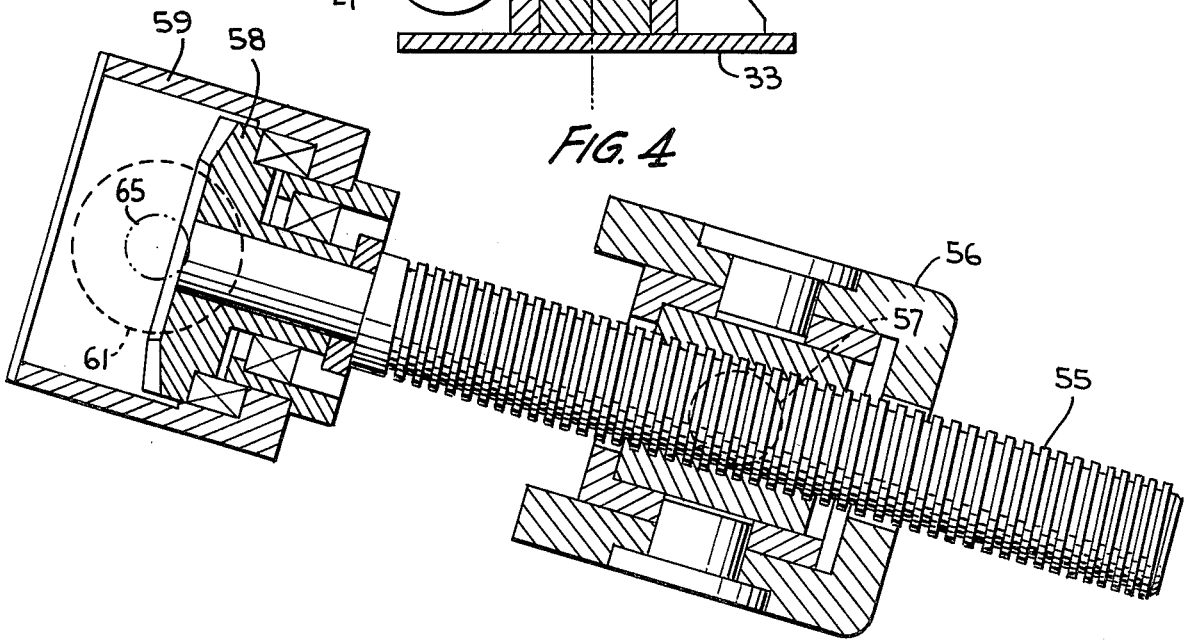
FIG. 4 is an enlarged sectional view of a detail of the FIG. 1 showing.

The aforementioned control device comprises an externally threaded elongated spindle 55 surrounded by an interally threaded sleeve assembly 56 which is mounted on arm 21 for pivotal movement as at 57 about the pivotal axis thereof which lies parallel to the axis of pivotal joint 23. The inner end of the spindle has a bevel gear 58 fixedly mounted thereon and seated on an anti-friction bearing within a cup-shaped portion 59 (FIG. 4) of holder 24. Another spindle 55' having a bevel gear 58' thereon is mounted on arm 22 and is seated on holder 25 (FIG. 3) in the same manner as described with reference to spindle 55.

The cup-shaped portions of holders 24 and 25 are provided with openings 61, 62 having anti-friction bearings therein, and shafts 63, 64 extend through these openings against the bearings. Beveled gears 65 and 66 are provided at the outer ends of these shafts and are respectively in toothed engagement with bevel gears 58, 58'. An elongated rod, having telescoping sections 67, 68 interconnects shafts 63 and 64 as by a coupling 69 between shaft 63 and section 68, and a coupling 71 between section 67 and shaft 64. The spacing between support arms 21 and 22 may thus be adjusted to accommodate different lengths of rewind rolls. Otherwise, a rod having a fixed length may interconnect shafts 63 and 64 at couplings 69 and 71, and the spacing between holders 21 and 22 may be adjusted by simply replacing this rod with a suitable length of another rod or rods.

A sprocket 72 is provided on shaft 63 and a sprocket 73 extends from motor 54, and a drive chain 74 or the like extends about both sprockets. Thus, upon operation of the motor, which is mounted on holder 24 by means of a bracket 74, both shafts 63 and 64 are rotated to thereby effect simultaneous rotation of spindles 55 and 55' about their central axes. The spindles are suitably threaded to cause sleeves 56 and 56' to move toward the outer ends thereof upon spindle rotation, whereupon support arms 21 and 22 are pivoted outwardly about their pivots 23 and 23' so as to maintain the predetermined extent of gap 51. Thus, whenever the extent of gap 51 decreases below a desired amount the diameter of rewind roll 18 increases thereby moving contact drum 41 toward the periphery of main drum 11 against the bias of spring 48, this decreased gap value is sensed by detecting devices 52 and 53 which function to start the operation of motor 54. These detecting devices may be in the form of spring-biased stems spaced a predetermined distance away from a fixed wall of the machine frame so that, when the stems contact this wall as the extent of gap 51 decreases beyond the desired value, they function as pushbuttons to start the motor. Other forms of detecting devices are also made possible without departing from the spirit of the invention, e.g. photocells.

Spindles 55 and 55' may be longer than shown in the drawings to facilitate removal from or inspection of rewind roll 18. A separate control device (not shown) may be provided for operating motor 54 for simultaneous rotation of both spindles causing threading movement of sleeves 56 and 56' toward the outer ends of the spindles until support arms 21 and 22 are pivoted sufficiently far away from centerline 19 until rewind roll 18 rests upon the floor supporting the machine frame or upon some other support (not shown) such as a cart. A completely wound rewind roll may thus be removed from its support arms, or a partially wound rewind roll may be easily observed and checked for quality. Removal of the rewind roll may be carried out by the machine operator without the need for special handling of equipment and with little physical exertion. After removal, empty cores or winding shafts may be inserted into the machine.

It should be pointed out that stops of any suitable type may be provided for limiting the outward pivotal extent of second support arms 38 and 39 in the rewind roll removal mode.

It is to be further pointed out that the central axes of spindles 55 and 55' are disposed parallel to front side 20 of rewind roll 18. These spindles, bevel gears 58, 58', 65, 66 as well as shafts 63, 64 and telescoping sections 67 and 68, together form a gearing assembly such that the mutual spacing of first support arms 21 and 22, for a given rewind roll 18, may be changed without disengaging the intermeshing of bevel gears 65, 58 and of bevel gears 66, 58'. And, as seen in FIG. 1, the pivot joints of second support arms 38 and 39 are disposed in such a relation to main drum 11 as to lie opposite the initial line 14 of contact at which web 13 enters the machine. It is likewise clear from FIG. 1 that circular guide rails 26 and 27 are disposed opposite line 14, of contact in relation to main drum 11. Such an arrangement permits the invention to be carried out in an improved manner over prior known machines.

The winding machine as aforedescribed is in no way limited to a single pair of holders 24 and 25 (on both sides of centerline 19) shown in FIGS. 2 and 3. Rather, provision can be made for several pairs of such holders arranged side-by-side so that, as viewed in FIG. 1, the several pairs of holders will be disposed one behind the other. And, additional pairs of holders, for accommodating additional rewind rolls, may be provided at the left of centerline 19.

With the arrangement according to the invention each contact drum bears against its respective rewind roll and is arranged independently of the other contact drums for independent operation. Completely wound rewind rolls, dispite their heavy weight, can be easily removed and empty winding cores or shafts replaced by a single operator, without the need for additional handling equipment or personal. Besides, the present arrangement is rigid and compact and is not inclined to vibrate during operation. Furthermore, several web strips such as 15 or 17 may be wound onto a common winding shaft or winding core in such a manner that the rewind rolls which are formed abut one another and respectively bear against individual contact drums. It is also possible to arrange several winding cores on a common winding shaft.

The present arrangement also makes possible the provision of a toothed rack (not shown) extending transversely over the width of the machine, and pinions (also not shown) associated with the pairs of holders 24, 25 in engagement with such rack to facilitate movement of the holder pairs manually or by means of a motor along guide rails 26 and 27 to a desired position.

From the foregoing, it can be seen that a winding machine is provided for winding up a plurality of strips cut from an elongated web in such a manner that contact drums press against the rewind rolls individually so that gaps such as 51 are individually maintained between the contact drums and the main drum within narrow limits. Such is carried out independently of the weight of the rewind rolls or of the thickness of each strip being wound. Also, the completely wound roll may be pivoted easily out of its winding position into a repository position, so that it may be easily deposed there on an available cart or the like in such a manner that it need not be removed manually from the machine by an attendant. The present arrangement is also considerably more rigid than prior winding machines so that any bending, during the winding process, of winding shafts or winding cores, etc., especially during the winding of large and heavy rolls, may have a considerably reduced effect as compared to previously known winding machines. The path of the strips to be wound will be maintained more precisely than before with the present arrangement, when winding even large and heavy rolls. Deviations of the strips to be wound from their path are substantially avoided, so that the individual windings of the rewind roll lie closely aligned with one another in a direction along the winding axis so that the front of each roll has individual windings lying in a single plane perpendicular to the winding axis. Moreover, the present machine may be set for different formats, i.e., various widths of strips to be wound in rolls.

Obviously, many modifications and variations of the present invention are made possible in the light of the above teachings. It is therefore to be understood that within the scope of the appended claims the invention may be practiced otherwise than as specifically described.

What is claimed is:

1. In a winding machine for winding up a plurality of strips cut from an elongated web after making initial contact with a main drum, the strips being looped partially around the main drum and being wound into a plurality of rewind rolls, contact drums respectively bearing against said rolls, means maintaining said contact drums out of contact with said main drum during build-up of said rolls so as to define predetermined gaps with said main drum, and means for sensing the position of said contact drums relative to said main drum, the improvement wherein said maintaining means comprise spaced holders mounted for movement along an axis parallel to the central axis of said main drum, pairs of first support arms mounted on said holders for supporting said rolls for pivotal movement about pivotal axes lying parallel to said central axis, threaded elongated spindles, means pivotally mounted on said arms and threadedly engaging said spindles, means for rotating said spindles together for effecting simultaneous movement of said rolls about said pivotal axes as said means engaging said spindles threads therealong, and second arms supporting said contact drums, said second arms being mounted for pivotal movement about axes disposed at a side of said main drum opposite the side at which initial contact is made by said web.

2. The machine according to claim 1, wherein said rotating means includes means extending between said spindles for adjusting the spacing between said first arms in said pairs to accommodate rolls of different lengths.

3. The machine according to claim 1, wherein said rotating means includes gear means on said spindles, means extending between said spindles in toothed engagement with said gear means, said extending means including a telescoping rod for adjusting the spacing between said first arms in said pairs to accommodate rolls of different lengths.

4. The machine according to claim 1, wherein said holders are slideably mounted on guide rails disposed at a side of said main drum opposite the side at which initial contact is made by said web.

* * * * *